US007277059B2

(12) United States Patent
Lin et al.

(10) Patent No.: US 7,277,059 B2
(45) Date of Patent: Oct. 2, 2007

(54) MONOPOLE ANTENNA ASSEMBLY

(75) Inventors: Hsien-Chu Lin, Tu-Chen (TW); Lung-Sheng Tai, Tu-Chen (TW); Chia-Ming Kuo, Tu-chen (TW); Zhen-Da Hung, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 146 days.

(21) Appl. No.: 10/841,380

(22) Filed: May 7, 2004

(65) Prior Publication Data

US 2004/0222940 A1 Nov. 11, 2004

(30) Foreign Application Priority Data

May 7, 2003 (TW) ..... 92208373 U

(51) Int. Cl.
*H01Q 1/12* (2006.01)

(52) U.S. Cl. ..... 343/718; 343/900

(58) Field of Classification Search ..... 343/906, 343/892, 700 MS, 702, 718, 900
See application file for complete search history.

(56) References Cited

U.S. PATENT DOCUMENTS 3,509,570 A * 4/1970 Lindsey et al. ..... 343/718
5,015,194 A * 5/1991 Seas ..... 439/314
5,654,740 A * 8/1997 Schulha ..... 345/156
5,913,174 A * 6/1999 Casarez et al. ..... 455/557
5,936,581 A * 8/1999 Roshitsh et al. ..... 343/702
6,188,918 B1 * 2/2001 Cockson ..... 455/575.7
6,236,574 B1 * 5/2001 Han ..... 361/816
6,331,838 B1 * 12/2001 Scott et al. ..... 343/715
6,356,237 B1 * 3/2002 Kim ..... 343/713
6,473,043 B1 * 10/2002 Hwang ..... 343/702
2002/0015000 A1 * 2/2002 Reece et al. ..... 343/795
2004/0108960 A1 * 6/2004 Kuo et al. ..... 343/767
2004/0233121 A1 * 11/2004 Lin et al. ..... 343/906
2005/0017912 A1 * 1/2005 Azoulay et al. ..... 343/725

* cited by examiner

*Primary Examiner*—Don Wong
*Assistant Examiner*—Angela M Lie
(74) *Attorney, Agent, or Firm*—Wei Te Chung

(57) ABSTRACT

A monopole antenna assembly mounted onto a bracket (2) of an electronic device includes an electronic connector (1) having a long contact (12) extending outwardly. The long contact acts as a radiating element of a monopole antenna. The long contact can be easily obtained by modifying the size of contact in stamping process. The connector electrically and mechanically cooperates with a socket, such as a female connector, of the electronic device. Thus an electrical path is formed between the monopole antenna and the electrical device via connector and the socket.

1 Claim, 7 Drawing Sheets

| Frequency(MHz) | VSWR |
|---|---|
| 1: 2400.0000 | 1.352 |
| 2: 2450.0000 | 1.188 |
| 3: 2500.0000 | 1.412 |

Socale: 5dBi/div
Operating Frequency: 2.5GHz
Horizontally polarized in X-Y plane Socale: 5dBi/div
Operating Frequency: 2.5GHz
Vertically polarized in X-Y plane Socale: 5dBi/div
Operating Frequency: 2.5GHz
Horizontally polarized in Y-Z plane Socale: 5dBi/div
Operating Frequency: 2.5GHz
Vertically polarized in Y-Z plane

MONOPOLE ANTENNA ASSEMBLY

CROSS-REFERENCE TO RELATED APPLICATION

The present application is related to a U.S. patent application entitled "MONOPOLE ANTENNA ASSEMBLY", having an unknown serial number, contemporaneously filed and assigned to the common assignee.

BACKGROUND OF THE INVENTION

1. Field of the Invention

The present invention relates to an antenna assembly, and in particular to a monopole antenna assembly employed in an electronic device.

2. Description of the Prior Art or Related Art

Today some products applied in Wireless Local Area Network (WLAN), such as WLAN Cards for desktop or laptop computer and WLAN Access Points (APs) under IEEE802.1a/b standards have been introduced into the market. These communication devices benefit from external antennas or internal antennas. In order to fully utilize the space of the laptop computer, the internal antenna is mostly adopted to be assembled into a hinge or a backplane of a liquid crystal display of the laptop computer. But for the desktop computer, the efficient of utilizing space is not very important. So a simple antenna assembly with a perfect radiating pattern is especially important.

U.S. Pat. No. 5,603,630 has disclosed an antenna assembly. This antenna assembly comprises an adaptor 10, an antenna 35 and a socket 13. The adaptor 10 comprises an end 11 for electrically and mechanically coupling with a plug 31 of the antenna 35 and a connection means 12 for cooperating with the socket 13. The antenna 35 electrically couples to a transceiver via the adaptor 10 and the socket 13. However, this antenna assembly is not simple enough. Respectively manufacturing the antenna, the adaptor and the socket also result in a complex process.

Hence, an improved antenna assembly is desired to overcome the above-mentioned disadvantages of the prior art.

BRIEF SUMMARY OF THE INVENTION

A primary object of the present invention is to provide a monopole antenna assembly with simple structure for an electronic device.

A monopole antenna assembly in accordance with the present invention mounted onto a bracket of an electronic device comprises an electronic connector having a long contact extending outwardly and a plug end. The long contact acts as a radiating element of a monopole antenna. The long contact can be easily obtained by modifying the size of contact in stamping process. The plug end electrically and mechanically cooperates with a socket (such as a female connector) of the electronic device. Thus an electrical path is formed between the monopole antenna and the electrical device via the socket.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
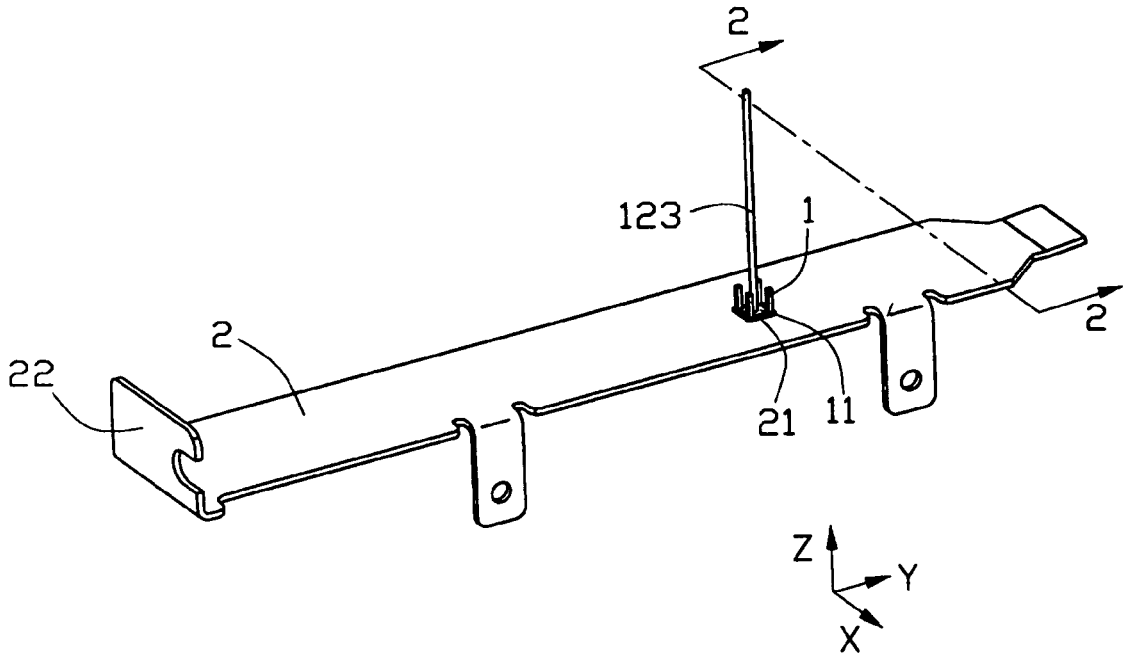
FIG. 1 is a perspective view of a preferred embodiment of a monopole antenna assembly in accordance with the present invention mounted on a bracket of an electronic device (not shown).

Referring to FIG. 1, a monopole antenna assembly comprises an electronic connector 1 assembled on a bracket 2 of an electronic device (not shown).

Figure 2:
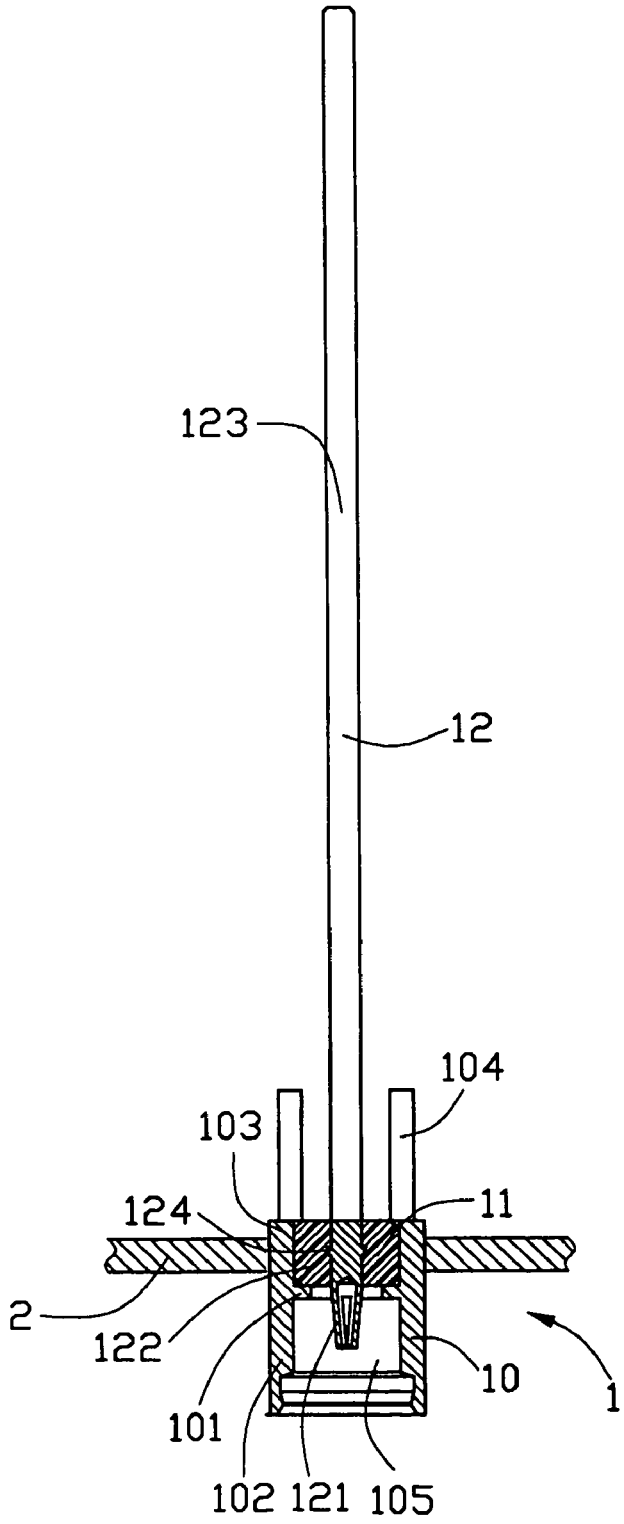
FIG. 2 is an enlarged cross-sectional view of an electronic connector of the monopole antenna assembly along line 2-2 of FIG. 1.

Referring to FIG. 1 and FIG. 2, The electronic connector 1 comprises a metal shield 10 divided into an upper portion 103 and a lower portion 102 by a baffle 101, a dielectric housing 11 received in the upper portion 103, a receiving room or mating port 105 defined in the lower portion 102 and a long contact 12 getting through the receiving room 105. Four mounting legs 104 are parallel to the long contact 12 and respectively set on four corners of a top surface of the upper portion 103. The long contact 12 comprises a plug end 121 received in the receiving room 105 for complementarily engaging with another electronic connector (not show) of the electronic device, a retaining part 122 surrounded by the dielectric housing 11 and a main radiating branch 123 protruding a predetermined distance from the upper portion 103. A pair of barbs 124 protrude from the surface of the retaining portion 122 and are fully inserted into the dielectric housing 11.

The bracket 2 is a metal sheet mounted on a panel of the electronic device (such as a desktop computer). The bracket 2 comprises a hole 21 and a mounting portion 22 for mounting the bracket 2 onto the electronic device. The monopole antenna assembly gets through the hole 21 with a part of the electronic connector 1 below a bottom surface of the bracket 2 and another part above a top surface of the bracket 2. The shield 10 of the electronic connector 1 is soldered to the bracket 2.

The radiating branch 123 is perpendicular to the bracket 2 to achieve a better radiating pattern. In this embodiment, the electronic connector 1 is a male connector for engaging with a female connector (not shown) of a feeder cable assembly (not shown). The feeder cable has a signal line making electrical connection with the contact 12 through the contacts of the male and female connectors. The feeder cable also has a ground line founding an grounding connection path between the shields of the male and female connectors and the bracket 2. Thus the radiating branch 123 the shield 10 and the feeder cable form a monopole antenna. The shield 10 is soldered onto the bracket 2 to obtain a larger grounding area for the monopole antenna.

In fact, this monopole antenna assembly is just an electronic connector having a long radiating branch 123 of the contact 12 and an adaptor portion for engaging with a female connector. Thus this monopole antenna assembly is easily manufactured only by modifying the size of the contact of the electronic connector in stamping process.

In some case, the radiating branch 123 may be embodied into other configuration such as helix.

Figure 3:
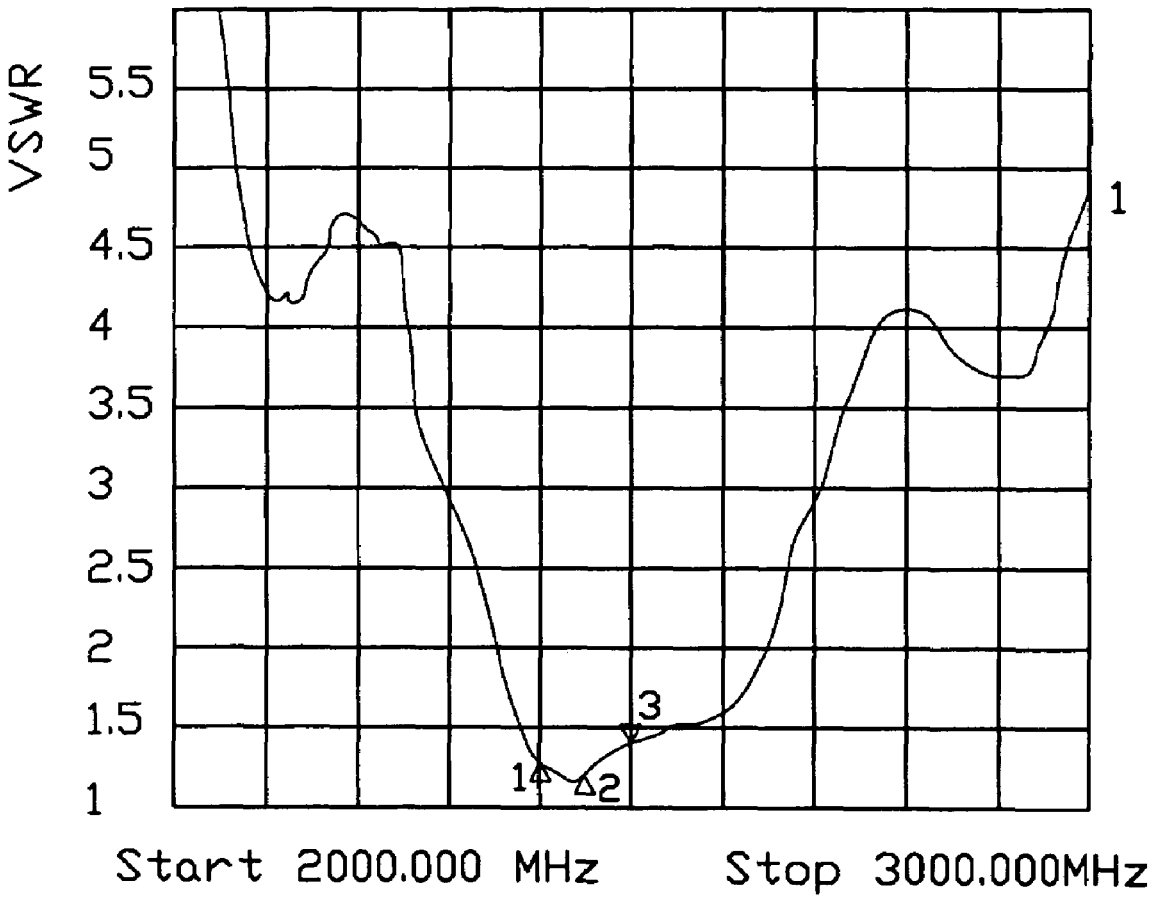
FIG. 3 is test chart recording for the monopole antenna assembly of FIG. 1, showing Voltage Standing Wave Ratio (VSWR) as a function of frequency.
Figure 4:
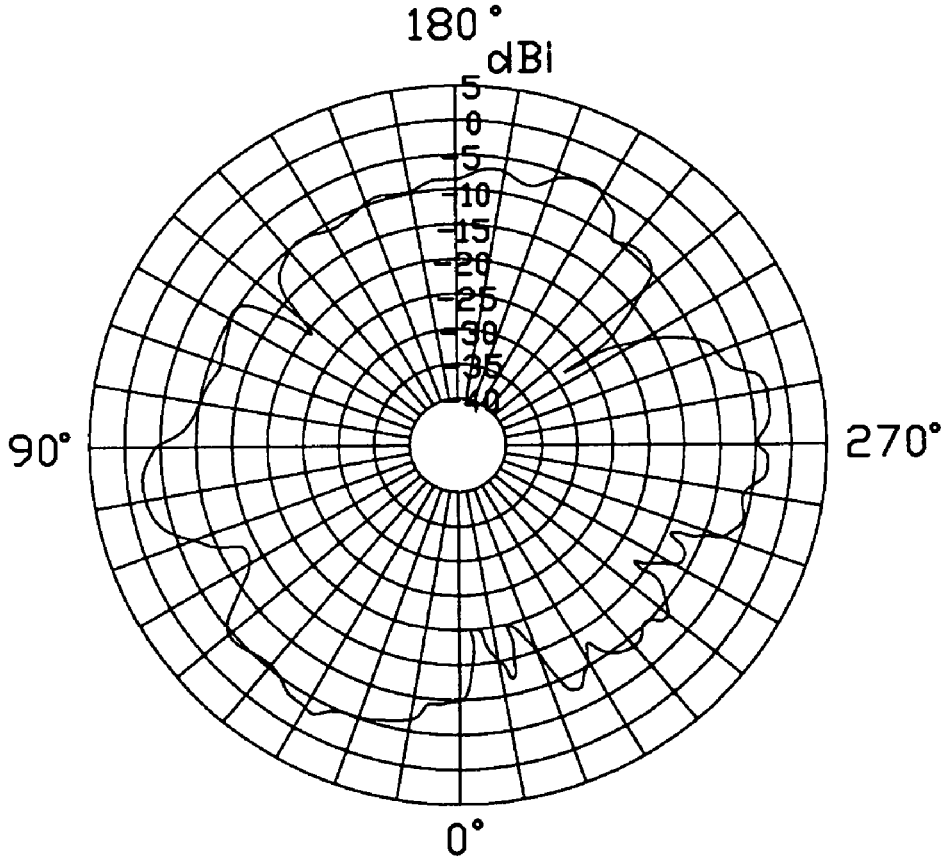
FIG. 4 is a recording of a horizontally polarized principle plane radiation pattern in X-Y plane of the monopole antenna assembly of FIG. 1 operating at a frequency of 2.5 GHz.
Figure 5:
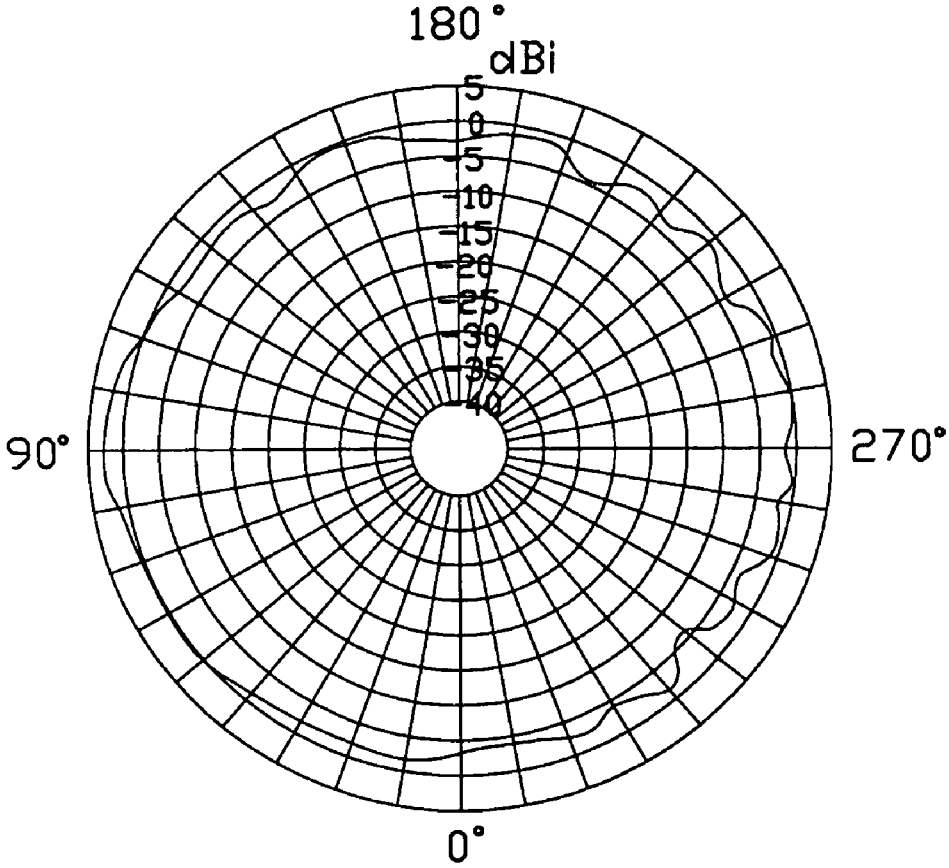
FIG. 5 is a recording of a vertically polarized principle plane radiation pattern in X-Y plane of the monopole antenna assembly of FIG. 1 operating at a frequency of 2.5 GHz.
Figure 6:
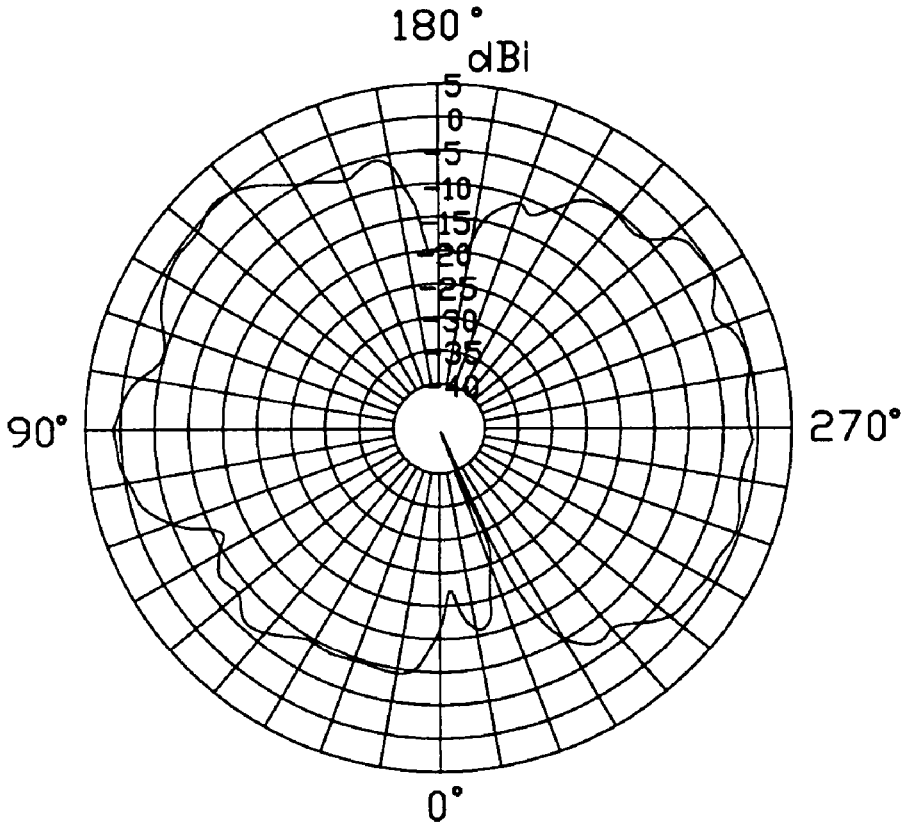
FIG. 6 is a recording of a horizontally polarized principle plane radiation pattern in Y-Z plane of the monopole antenna assembly of FIG. 1 operating at a frequency of 2.5 GHz.
Figure 7:
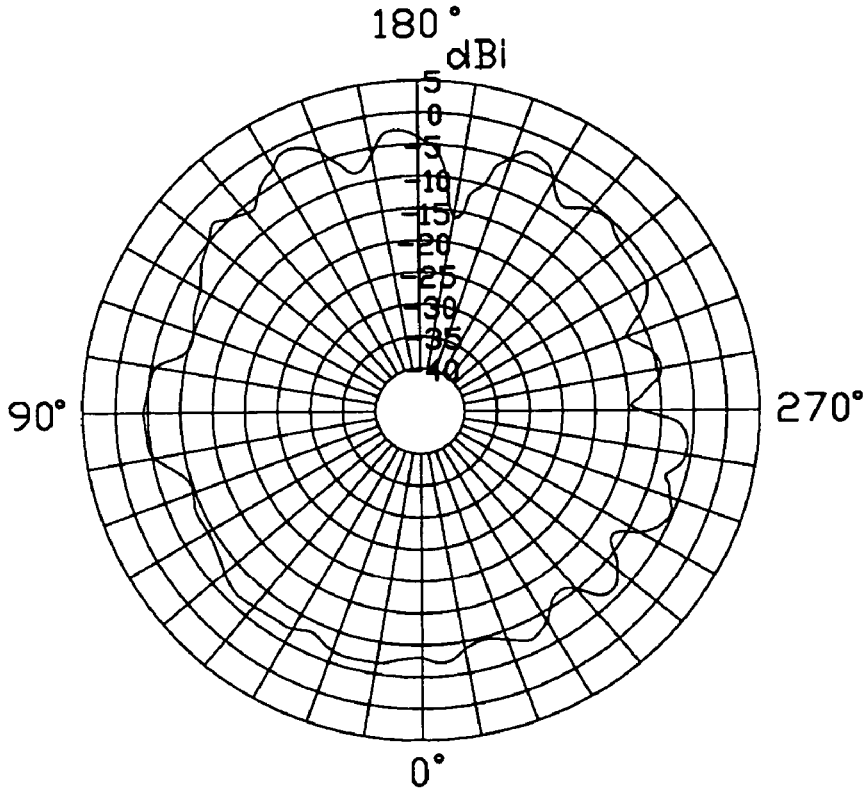
FIG. 7 is a recording of a vertically polarized principle plane radiation pattern in Y-Z plane of the monopole antenna assembly of FIG. 1 operating at a frequency of 2.5 GHz.

FIG. 3 shows a test chart recording of Voltage Standing Wave Ratio (VSWR) of the monopole antenna assembly as a function of frequency. Note that VSWR drops below the desirable maximum value "2" in the 2.38-2.5 GHz frequency band, indicating acceptably efficient operation in the frequency band.

FIGS. 4-7 show horizontally and vertically polarized principle plane radiation patterns of the monopole antenna assembly operating at frequencies of 2.5 GHz. Note that each radiation pattern is close to a corresponding optimal radiation pattern and there is no obvious radiating blind area.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A monopole antenna assembly for mounting on a bracket of an electronic device, comprising an electronic connector mounted on the bracket, the connector comprising a shield, a dielectric housing surrounded by the shield and a contact fixed in the housing, the contact comprising a long radiating branch extending outwardly a predetermined distance from the housing; wherein the shield is soldered onto the bracket; wherein the shield of the male connector acts as a ground portion; wherein the electronic connector comprises an upper portion for receiving the dielectric housing and a lower portion for engaging with a female connector of the electronic device; wherein the contact comprises a retaining portion retained in the housing and a plug end received in the lower portion; wherein the retaining portion comprises a pair of barbs protruding into the housing.

* * * * *